US008272193B2

(12) United States Patent
Edwards et al.

(10) Patent No.: US 8,272,193 B2
(45) Date of Patent: Sep. 25, 2012

(54) METHOD FOR HANDLING AND PLACEMENT OF ITEMS ON AN ASSEMBLY LINE

(75) Inventors: Robert Edwards, Belleville (CA); Michael Elent, Toronto (CA)

(73) Assignee: Parmalat Canada Inc. (CA)

( * ) Notice: Subject to any disclaimer, the term of this patent is extended or adjusted under 35 U.S.C. 154(b) by 0 days.

(21) Appl. No.: 13/185,745

(22) Filed: Jul. 19, 2011

(65) Prior Publication Data

US 2011/0271648 A1 Nov. 10, 2011

Related U.S. Application Data

(62) Division of application No. 12/417,225, filed on Apr. 2, 2009, now Pat. No. 8,001,746.

(60) Provisional application No. 61/116,728, filed on Nov. 21, 2008.

(51) Int. Cl.
*B65B 1/20* (2006.01)

(52) U.S. Cl. ..... 53/428; 53/450; 53/236

(58) Field of Classification Search ..... 53/428, 53/450, 438, 211, 236, 237, 206, 173
See application file for complete search history.

(56) References Cited

U.S. PATENT DOCUMENTS

| | | | | |
|---|---|---|---|---|
| 3,577,293 | A * | 5/1971 | Ritterhoff | 156/156 |
| 3,866,388 | A * | 2/1975 | Koehler, III | 53/500 |
| 4,052,836 | A | 10/1977 | Shaw | |
| 4,103,692 | A * | 8/1978 | Baier et al. | 131/32 |
| 4,626,439 | A | 12/1986 | Meyer | |
| 4,648,237 | A | 3/1987 | Total | |
| 4,902,523 | A | 2/1990 | Fritchen et al. | |
| 5,388,385 | A * | 2/1995 | Phelps et al. | 53/247 |
| 5,426,917 | A | 6/1995 | Daane et al. | |
| 5,636,498 | A * | 6/1997 | Belanger et al. | 53/444 |
| 5,720,149 | A * | 2/1998 | Stimpfl | 53/244 |
| 5,934,046 | A | 8/1999 | Whittaker | |
| 5,960,609 | A * | 10/1999 | Abrams et al. | 53/428 |
| 6,141,943 | A * | 11/2000 | Hart et al. | 53/444 |
| 6,337,099 | B2 | 1/2002 | Hoogland | |
| 6,928,794 | B2 | 8/2005 | Hamer et al. | |
| 6,942,888 | B2 | 9/2005 | Mueller | |

FOREIGN PATENT DOCUMENTS

JP 07309433 11/1995

* cited by examiner

*Primary Examiner* — Sameh H. Tawfik
(74) *Attorney, Agent, or Firm* — Lando & Anastasi, LLP

(57) ABSTRACT

A method is described for manufacturing and/or packaging of multiple items simultaneously, in particular the handling and placement for packaging of the items on an assembly line. In particular, the method is for use in changing the center spacing of the simultaneously manufactured items between two locations on the assembly line.

8 Claims, 8 Drawing Sheets

METHOD FOR HANDLING AND PLACEMENT OF ITEMS ON AN ASSEMBLY LINE

RELATED APPLICATIONS

This application is a divisional application of U.S. patent application Ser. No. 12/417,225 filed on Apr. 2, 2009, which claims the benefit of U.S. Provisional Patent Application No. 61/116,728 filed on Nov. 21, 2008, which are both hereby incorporated by reference in their entirety.

FIELD OF THE INVENTION

The invention relates to handling and placement of items on an assembly line.

BACKGROUND OF THE INVENTION

In some manufacturing processes handling of products is necessary between product formation and packaging of the product. Excessive handling of products can damage and/or adversely affect the appearance of the products, especially if the product is a malleable material. When handling is required between product formation and packaging, it may be advantageous to automate an assembly line process to minimize and/or optimize handling of the product.

Furthermore, in some assembly and packaging processes manufactured products are output in a manner that is not optimum for final packaging of the product. A particular reason for optimizing the output may be to eliminate unnecessary packaging material that would otherwise be needed to facilitate packaging the product. Automating the assembly line process may aid in reducing costs and the amount of packaging materials needed to package the product. However, as discussed above, in some situations care must be taken to avoid excessive handling that may damage the product.

In addition to avoiding excessive handling, automating the assembly line process may reduce labour and aid in making the product cost competitive.

SUMMARY OF THE INVENTION

According to an aspect of the present invention, there is provided a method comprising: simultaneously for each of a plurality of food portions: at a first location, receiving a food portion of the plurality of food portions on a channel following block; moving the channel following block from the first location to a second location along a channel; wherein at the first location a spacing of the food portions received on the channel following blocks is equal to a first center spacing and at the second location the spacing of the food portions is equal to a second center spacing, which is different than the first center spacing.

In some embodiments moving the channel following block from a first location to a second location along a channel comprises: moving the channel following block around an exterior of a cylinder having a plurality of channels etched in an exterior surface of the cylinder, the plurality of channels being oriented in a direction substantially defining a circumference of a cylindrical cross section of the cylinder.

In some embodiments, the method further comprises removing the plurality of food portions from the channel following blocks at the second location.

In some embodiments, removing the plurality of food portions from the channel following blocks further comprises: the plurality of food portions being positioned on a bottom layer of packaging film and covered with a top layer of packaging film.

In some embodiments, the first center spacing is greater than the second center spacing.

In some embodiments, the method further comprises: extruding the plurality of food portions to be simultaneously received by the channel following blocks from an extrusion head comprising a plurality of outlets from which the food portions are extruded.

In some embodiments, at a first time, a first plurality of food portions are simultaneously received at a first location on each channel following block of a set of channel following blocks, and at a second time when the set of channel following blocks are moved to a new position, a second plurality of food portions are simultaneously received at a second location on each channel following block of the set of channel following blocks, the method further comprises: removing the first plurality of food portions from the first location on each channel following block of the set of channel following blocks onto a bottom layer of packaging film; removing the second plurality of food portions from the second location on each channel following block of the set of channel following blocks onto the bottom layer of packaging film; and covering the bottom layer of packaging film with a top layer of packaging film.

According to another aspect of the present invention, there is provided an apparatus comprising: a cylinder having a plurality of channels etched in an exterior surface of the cylinder, the channels being oriented in a direction substantially defining a circumference of a cylindrical cross section of the cylinder, the plurality of channels having a first spacing arrangement at a first location on the exterior surface of the cylinder and having a second spacing arrangement at a second location on the exterior surface of the cylinder; a plurality of rods, subsets of the plurality of rods being separated by an angular spacing around the circumference of the exterior surface of the cylinder and configured to rotate around the exterior surface of the cylinder; a plurality of channel following blocks, a subset of the plurality of channel following blocks slideably mounted on each of the subsets of the plurality of rods; each of the plurality of channel following blocks configured to receive at least one food portion; wherein when the plurality of rods are rotated around the exterior surface of the cylinder, a center spacing of food portions received at the first location is changed to a different center spacing at the second location as a function of the difference between the first spacing arrangement and the second spacing arrangement.

In some embodiments, the apparatus further comprises first and second elements, the first and second elements located at each respective end of the cylinder and rotatable around a longitudinal axis of the cylinder, wherein the plurality of rods are coupled to the first and second elements.

In some embodiments, the apparatus further comprises a servo motor configured to drive at least one of the first and second elements to rotate the plurality of rods around the drum.

In some embodiments, the servo motor drives a belt that rotates at least one of the first and second elements.

In some embodiments, the apparatus further comprises a comb style stripper for removing the plurality of food portions from the channel following blocks when a given subset of the plurality of rods reaches the second location.

In some embodiments, the apparatus further comprises a pneumatic cylinder configured to actuate the comb style stripper to remove the plurality of food portions.

In some embodiments, the center spacing at the first location is greater than the center spacing at the second location.

In some embodiments, the plurality of rods comprise eight pairs of rods, each pair separated by an angular spacing of approximately 45 degrees.

In some embodiments, the plurality of channels comprise twelve channels.

In some embodiments, the plurality of channel following blocks comprise twelve channel following blocks on each subset of the plurality of rods.

In some embodiments, each of the plurality of channel following blocks has two posts, each post configured to receive a food portion.

In some embodiments, each of the plurality of channel following blocks has a protrusion on the surface adjacent the exterior surface of the cylinder that substantially conforms to the shape of the channel and enables the channel following block to follow the path of the channel when the channel following block is rotated around the exterior surface of the cylinder.

In some embodiments, the apparatus further comprises a computer readable medium comprising computer readable instructions to be implemented by a processor for automating the apparatus.

According to yet another aspect of the present invention, there is provided an assembly line comprising an apparatus as described above and further comprising: an apparatus having an extrusion head with a plurality of outlets for extruding a food product, the apparatus configured for providing flows of the food product out of the plurality of outlets and onto the channel following blocks in discrete food portions; a first packaging apparatus configured for: sealing a bottom packaging film, on which two or more food portions removed from the channel following blocks are positioned, and a top packaging film that is laid over the bottom packaging film; and cutting the sealed top and bottom packaging film to produce individual packages comprising the food portions; and a second packaging apparatus for: grouping multiple individual packages together; and overwrapping the multiple individual packages to produce a bulk package.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

Embodiments of the invention will now be described with reference to the attached drawings in which.

DETAILED DESCRIPTION OF THE EMBODIMENTS OF THE INVENTION

Figure 1:
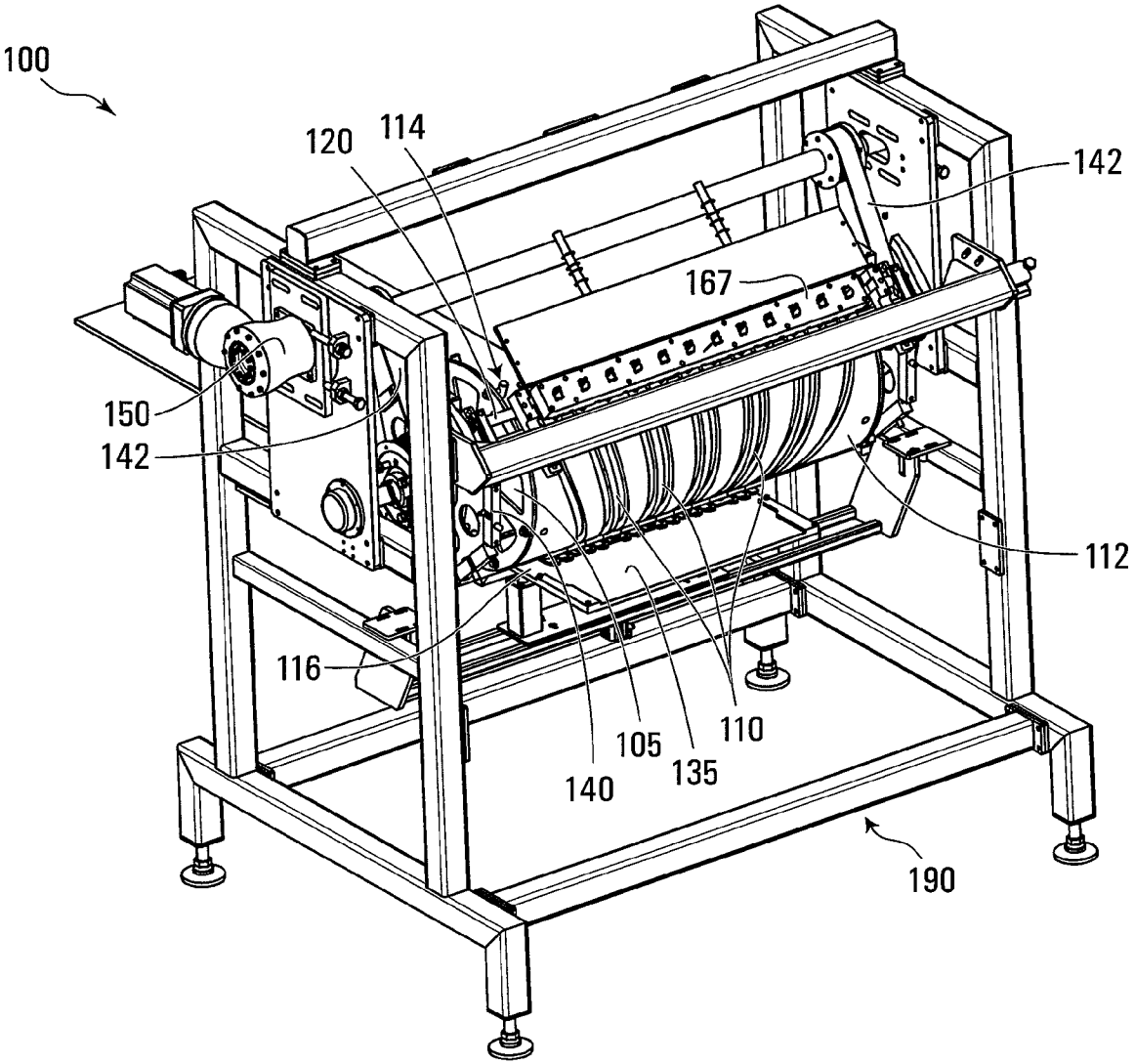
FIG. 1 is a schematic diagram of an apparatus according to an embodiment of the invention.

An apparatus and a method are described herein directed to manufacturing and/or packaging of multiple items simultaneously, in particular the handling and placement for packaging of the items on an assembly line. In particular, the apparatus and method are for use in changing the center spacing of the simultaneously manufactured items between two locations on the assembly line.

Automating the change of center spacing of manufactured items may also reduce labour costs of the manufactured items associated with packaging of the manufactured items, in particular placement during packaging.

A particular implementation of the apparatus is currently contemplated for use in manufacturing and/or packaging an extruded processed cheese food product. The apparatus provides a manner of advancing the extruded processed cheese product along the assembly/packaging line that reduces handling of the food product that may damage and/or adversely affect the appearance thereof. Some embodiments of the invention also enable the spacing between individual portions of the food product to be reduced with respect to one another prior to sealing the product in the packaging, thereby allowing less packaging material to be used.

An extrusion apparatus for producing multiple, simultaneously extruded food portions to the apparatus has an extrusion head having at least one input and multiple outlets. The multiple outlets allow multiple individual cheese product flows to be extruded simultaneously, one flow from each of the multiple outlets. The cheese product is extruded from the outlets of the extrusion head and a cutter cuts the respective extruded cheese product flows into portions of a desired thickness. The outlets of the extrusion head each have a respective shape such that the cheese portions are of a desired thickness and have a shape corresponding to that of the outlet from which the cheese product flow is extruded.

In a particular implementation of the extrusion apparatus, the cheese product flows and resulting extruded food portions have center spacings there between of approximately 3 inches. The desired spacing of the extruded cheese portions for packaging is less than 3 inches, so the center spacing of the food portions is desired to be decreased between the extrusion head and the location of final packaging of the extruded food portions.

In some embodiments, the extrusion head that generates the food portions may be part of the apparatus for modifying the spacing of the food portions. In some embodiments, the extrusion head is not part of the apparatus for modifying the spacing of the food portions, but is a separate apparatus that simply supplies the food portions to the apparatus for modifying the spacing of the food portions.

More generally, the apparatus for modifying the spacing of the food portions could be used for other types of products, for example other types of food items that excessive handling may damage and/or adversely affect the appearance of the product prior to packaging. In some embodiments, the apparatus could be used for handling non-food items. In some implementations, the apparatus is used to increase the center spacing betweens items by a desired amount. In some implementations, the apparatus is used to decrease the center spacing between items by a desired amount.

An example of an apparatus will now be described with reference to FIGS. 1, 2, 3, 4, 5A, 5B and 5C. Referring to FIG. 1, the apparatus 100 includes a stationary cylinder 105, hereinafter referred to as a drum. The drum 105 has multiple channels 110 engraved on an exterior surface 112 of the drum 105 in a direction substantially defining the circumference of the cylindrical cross section of the drum 105.

The apparatus 100 includes multiple sets of rods 120 running the length of the drum 105 that are rotatable around the exterior of the drum 105. In a particular implementation, there are a total of eight pairs of rods 120 that are configured to rotate around the exterior surface 112 of the drum 105. The pairs of rods 120 are attached to rotatable circular mounts 140 located at each end of the drum 105. The eight pairs of rods 120 are separated by an angular spacing of approximately 45 degrees around the circumference of the circular mounts 140. In FIG. 1, only a single pair of rods are illustrated, which are located under a portion 167 of the extrusion head, the portion 167 including the outlets from which the cheese portions are extruded. More generally, the number of rods in each set of rods and the number of sets of rods are implementation specific.

Figure 2:
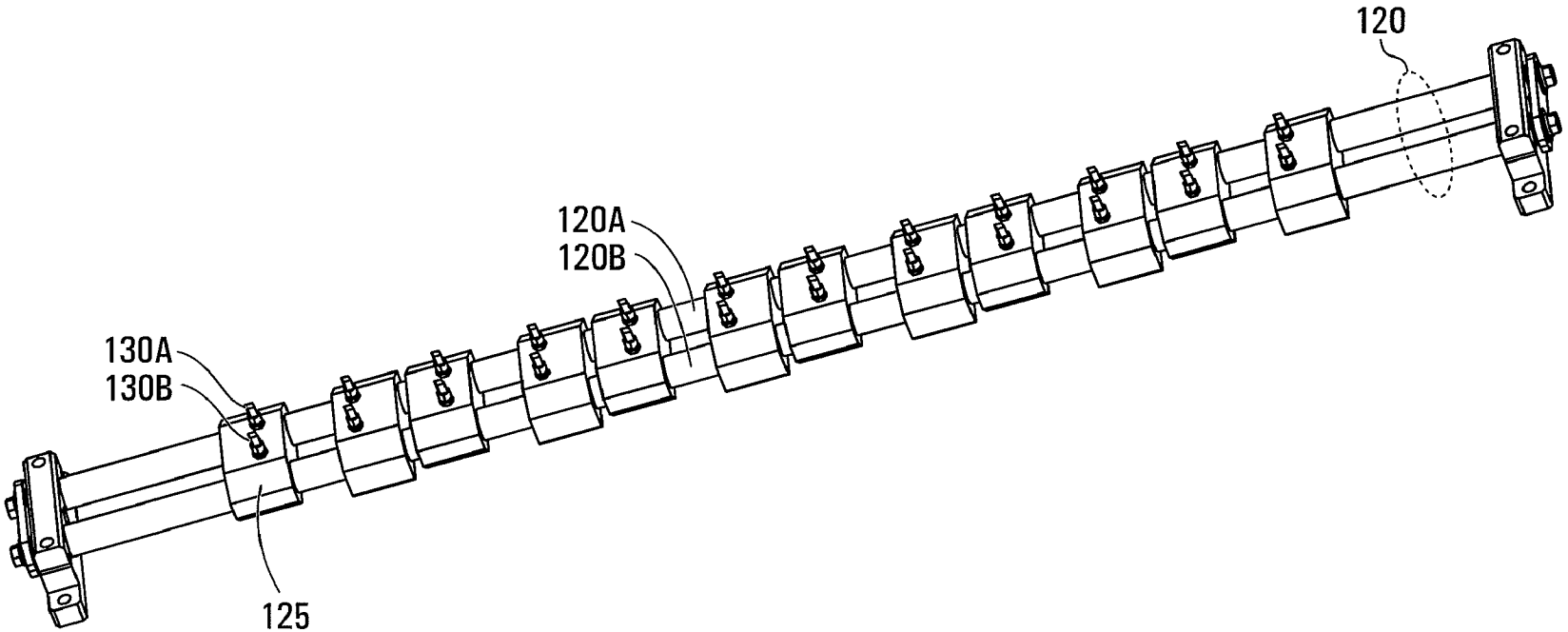
FIG. 2 is a schematic diagram of a pair of rods on which channel following blocks are slideably mounted according to an embodiment of the invention.

FIG. 2 illustrates a more detailed view of a single pair of rods 120, in which the individual rods are indicated by references 120A and 120B. The pair of rods 120 has twelve individual channel following blocks 125 mounted thereon. The channel following blocks 125 are mounted on the pair of rods 120 such that they are free to slide along the pair of rods 120. Each pair of rods 120 of the eight pairs of rods of the apparatus as discussed above is implemented in a similar manner.

Figure 3:
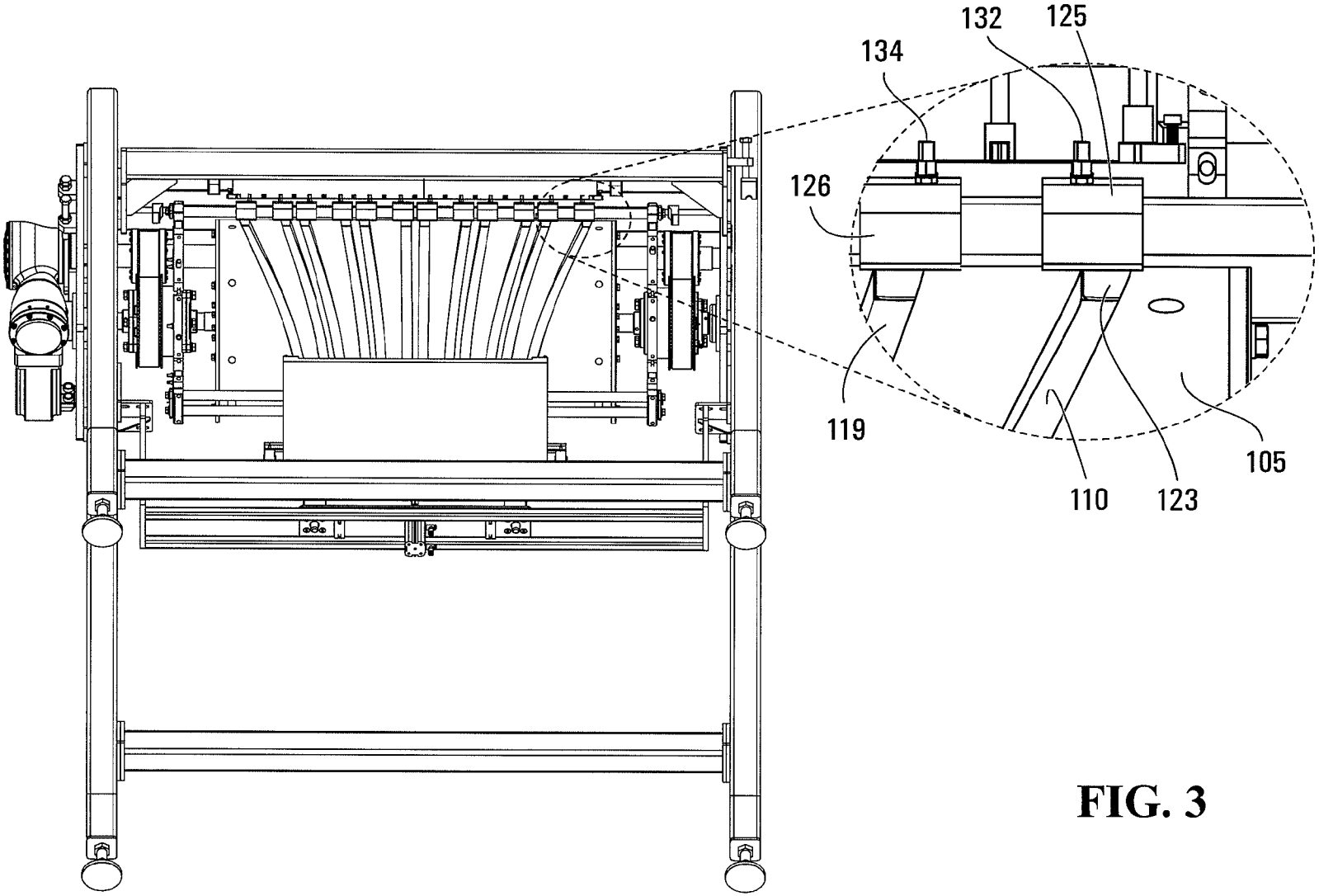
FIG. 3 is a schematic diagram of a channel following block interfacing with a channel according to an embodiment of the invention.

FIG. 3 illustrates a more detailed view of the manner in which the channel following blocks 125, 126 are able to follow the channels 110, 119 of the drum 105. The channel following blocks 125, 126 each have a protrusion 123 on a surface of the channel following block 125 that is adjacent to the surface 112 of the drum 105. The shape of the protrusion 123 substantially conforms to the shape of the respective channel that is being followed and enables the channel following blocks 125, 126 to follow the path of the channels 110, 119 when the channel following blocks 125, 126 are rotated around the drum 105. When the pairs of rods 120 are rotated around the drum 105, the channel following blocks 125 change their proximity to one another as the protrusions of each respective channel following block 125, 126 follows an associated channel and the distance between the channels varies.

With reference once again to FIG. 2, it can be seen that each of the channel following blocks 125 has two posts 130A and 130B on a surface of the channel following block 125 that is opposite to the surface on which the protrusion 123 is located. The food portions are extruded onto these posts 130A, 130B. The posts 130A, 130B hold the food portions as they are being cut by the cutter, after being extruded from the extrusion head 165, and as the food portions are rotated around the drum 105.

More generally, the number of posts per channel following block is implementation specific. In some embodiments the number of channel following blocks and the number of posts per channel following block is dependent upon the number of extruded food portions to be sealed in a single package.

In a particular implementation, the posts 130A, 130B are diamond shaped posts that leave a diamond shaped impression in the food portions when the food portions are removed from the posts. However, more generally, the posts could be any desirable shape.

In some embodiments, instead of using posts to hold the food portions in place on the channel following blocks, alternative ways are used for ensuring the food portions are held in place while being move around the drum.

As a first alternative example to using a post, each channel following block has a hole through the block to which a vacuum line is connected. The vacuum line creates suction that holds the food portion in place once the food portion has been extruded onto the channel following block. In some embodiments, such a vacuum line can be controlled to operate substantially only when the food portion is to be held to the drum, for instance between the first and second locations.

As a second alternative example to using a post, each channel following block has a recess into which the food portion can be extruded. Doors on the outside surface of the channel following block can close over the recess once the food portion is positioned in the recess to keep the food portion in place when the food portion is rotated from the first location to the second location.

In some embodiments, the posts 130A, 130B are located on the channel following blocks 125 such that the center spacing of the posts 130A, 130B is substantially the same as the center spacing of the channels 110 of which the channel following blocks 125 are following. In such a case the channels of the drum would be equally spaced apart at least at the first location and the second location and the posts would be located on the channel following blocks substantially over the channel that it was following.

In some embodiments, the posts 130A, 130B are located on the channel following blocks 125 such that the spacing of the posts 130A, 130B is different than the spacing of the channels 110 of which the channel following blocks 125 are following. For example, when there are multiple pairs of adjacent channel following blocks, for an adjacent pair of channel following blocks, the respective posts are located on the respective channel following blocks in such a manner that the spacing of the posts is less than the channel spacing of the channels. As a result the spacing of the posts is not the same as the spacing of the channels. Referring to FIG. 3, it can be seen that post 132 on channel following block 125 is offset to the left of channel 110 and post 134 on channel following block 126 is offset to the right of channel 119, resulting in the center spacing of posts 132 and 134 being less than the center spacing of channels 110 and 119. However, as the spacing of the posts varies with the change in the spacing of the channels, the center spacing of the posts is a function of the spacing of the channels.

Referring once again to FIG. 1, a servo motor 150 is used to drive the rotation of the circular mounts 140 around a longitudinal axis of the drum, which results in the multiple pairs of rods 120 being rotated around the surface 112 of the drum 105. In some embodiments, the servo motor 150 drives a belt 142, which rotates at least one of the circular mounts 140.

More generally, rotating the circular mounts around the exterior of the drum may be performed by any standard mechanical means including, but not limited to, pneumatics, hydraulics, gears, and direct drive.

The channels 110 are spaced apart at a first location 114 on the drum 105, which is the location at which the food portions are received by the apparatus 100 from the extrusion head 165. At the first location, the center spacing of the posts on the channel following blocks corresponds to the center spacing of the extruded food portions. The channels are spaced apart at a second location 116 on the drum 105 that is different than the spacing at the first location 114. The posts on the channel following blocks when rotated to the second location 116 have the desired center spacing. The second location 116 is the location on the drum 105 at which the food portions are removed for packaging. The center spacing at the second location 116 is different than that of the center spacing at the first location 114.

The center spacing of the food portions at the second location 116 is also such that an appropriate number of food portions are positioned in a desired array for packaging. In some embodiments, subsets of the food portions are arranged such that the food portions of individual subsets are group and centered within packaging that is designated for individual subsets.

Figure 4:
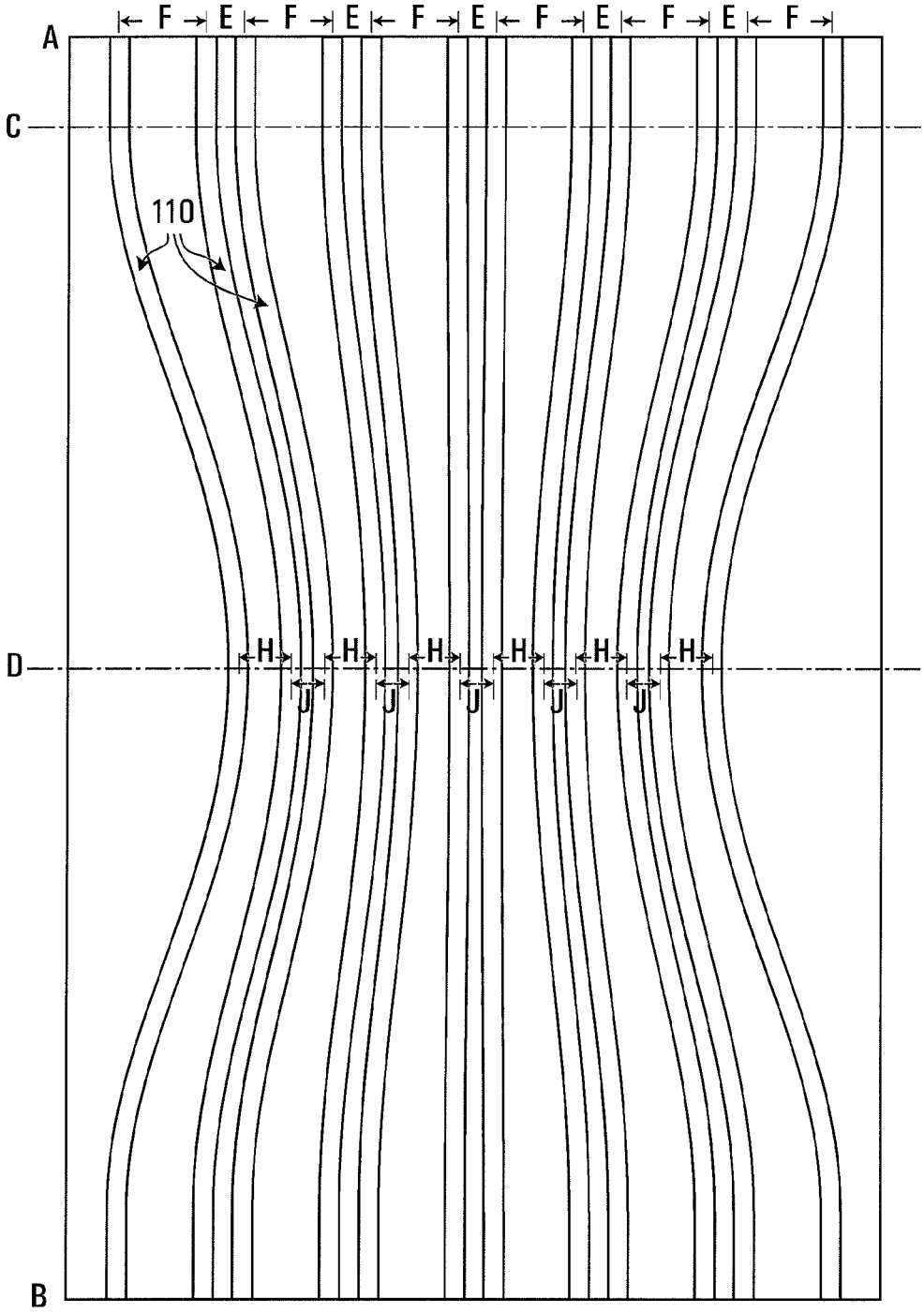
FIG. 4 is a schematic diagram of a two dimensional representation of a surface of a cylindrical drum used in an apparatus according to an embodiment of the invention.

FIG. 4 is a schematic diagram of a two dimensional representation of the surface of the drum which has been "unrolled" from the cylindrical shape of the drum to illustrate the path of the channels of the drum. If edges "A" and "B" were connected, the two dimensional surface would result in the cylindrically shaped drum.

FIG. 4 represents a surface of the drum for which the location of the posts on the channel following blocks are offset from the location of the channels, as described above with reference to FIG. 3. Therefore, there is not a common center spacing for the channels, but the posts on the channel following blocks do have a common center spacing. Line "C" is the first location on the drum for which the spacing between the channels is either a first distance "E" or a second distance "F". Line "D" is a second location in the drum for which the spacing between the channels is a third distance "J" or a fourth distance "H". As the sets of rods are rotated around the drum from the first location C to the second location D, the channel following blocks 125 follow the channels 110. In doing so the channel following blocks 125 may slide along the sets of rods 120, resulting in the center spacing of the food portions located on the posts being changed from the received center spacing to the desired center spacing.

Alternatively to the design illustrated in FIG. 4, in another embodiment in which the spacing of the posts on the channel following blocks line up with the spacing of the channels, there is a common center spacing for both the posts and the channels which is the same.

In FIG. 1, the apparatus 100 includes a comb style stripper 135 at the second location 116 for the purpose of removing the food portions from the posts when the channel following blocks 125 are rotated to and arrive at the second location 116.

Figure 5B:
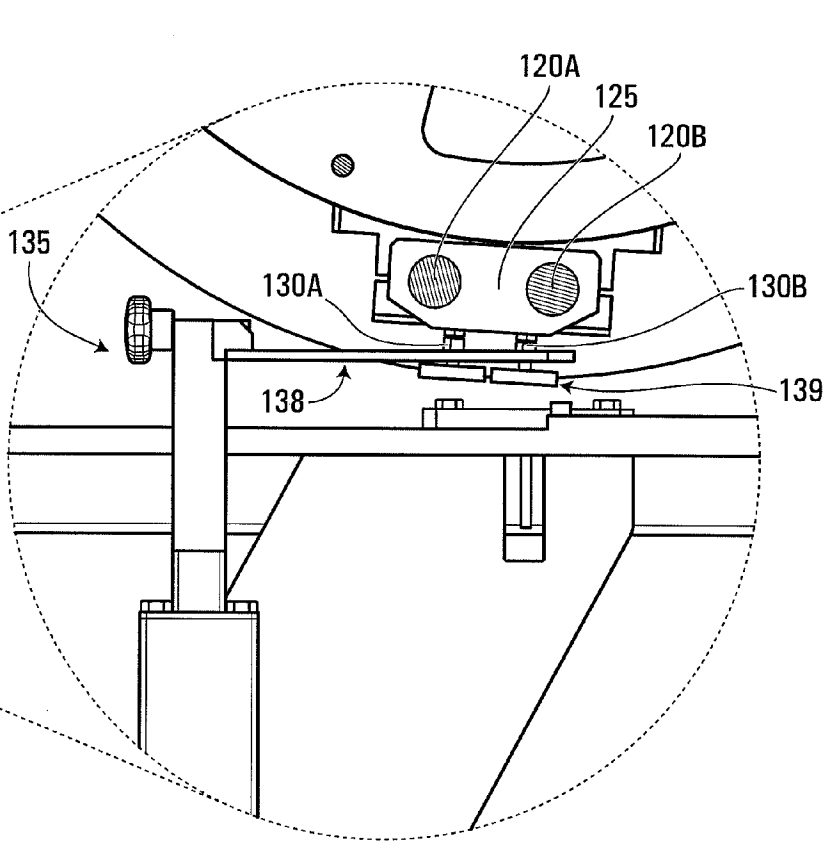
FIG. 5B is a schematic diagram of an enlarged view of a portion of FIG. 5A illustrating a comb style stripper according to an embodiment of the invention.
Figure 5A:
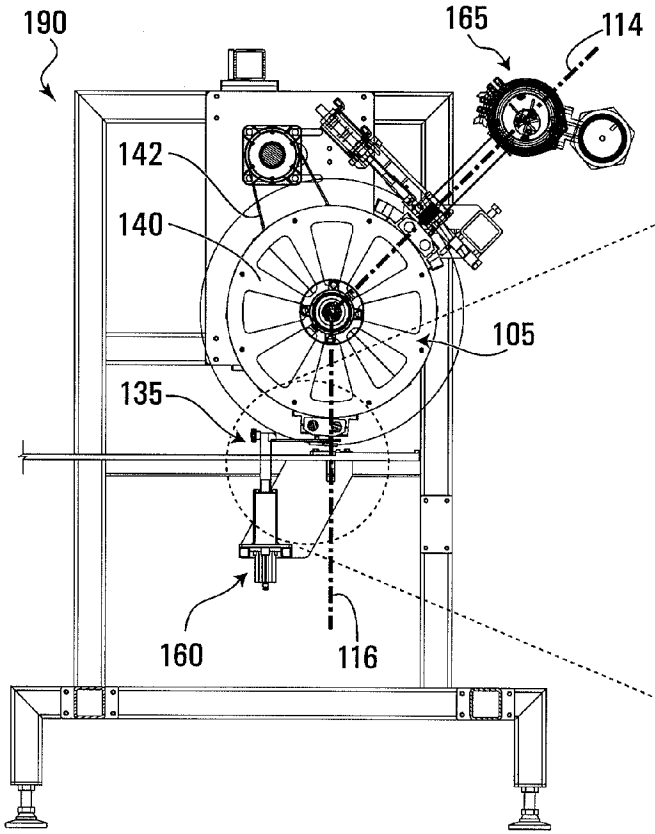
FIG. 5A is a schematic diagram of an end view of the apparatus of FIG. 1.

FIGS. 5A and 5B show a more detailed view of the comb style stripper 135 and its position in relation to the apparatus 100. The end view of FIG. 5A shows the comb style stripper 135 located at the second location 116. A pneumatic cylinder 160 is coupled to the comb style stripper 135 which enables the comb style stripper 135 to move up and down in the vertical direction to remove the food portions 139 from the posts 130A, 130B of the channel following blocks 125. While FIG. 5A illustrates a pneumatic cylinder 160 being used to actuate the comb style stripper 135, more generally, the comb style stripper 135 may be actuated by any standard mechanical means including, but not limited to, pneumatics, hydraulics, gears, and direct-drive.

Figure 5C:
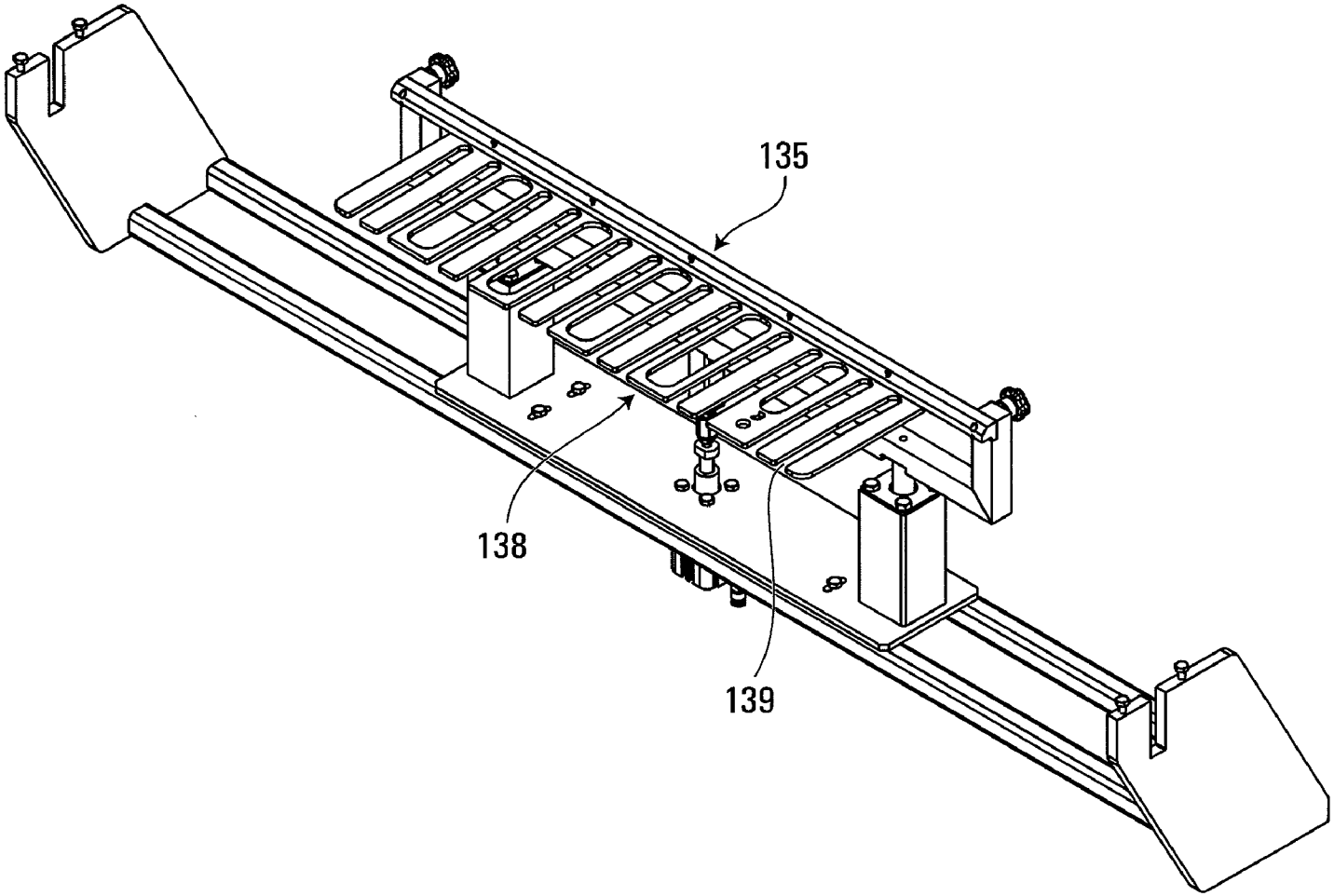
FIG. 5C is an alternative view of a schematic diagram of a portion of a comb style stripper according to an embodiment of the invention.

In FIG. 5C, the comb style stripper 135 is shown to be formed from a thin sheet of metal 138 with grooves 139 cut in the metal sheet 138 that correspond to the position of the posts of the channel following blocks having the desired center spacing of the second location 116. The comb style stripper 135 is configured to operate in a manner that upon receiving a signal that the food portions have arrived at the second location 116, the comb style stripper 135 pulls the food portions off of the posts 130A, 130B without allowing directional movement other than vertical movement.

In some embodiments, the comb style stripper 135 may be a single device used to extricate all the food portions of a collection of channel following blocks on a pair of rods off of their respective posts simultaneously, for example as illustrated in FIG. 5C. In some embodiments, the comb style stripper 135 may be a set of multiple devices, each used to remove the food portions off of the posts of one or more channel following blocks. Multiple such devices would be used to remove the food portions off of the posts of the all of the channel following blocks.

In some embodiments the comb style stripper is not part of the apparatus. For example, when suction is used to maintain the food portions on the channel following block, one possible manner of removing the food portions from the channel following blocks is by discontinuing the vacuum and allowing the food portions to fall off the channel following blocks and land on a packaging medium. As a further example, when doors are used to maintain the food portions in a recess of the channel following block, the food portions can be removed from the channel following blocks by opening the doors and allowing the food portions to fall out of the recess of the respective channel following blocks and onto a packaging medium.

In operation, the apparatus 100 receives a plurality of individual food portions that are extruded simultaneously at the first location, with each portion being extruded onto a respective post. The food portion may or may not touch a surface of the channel following block. The posts hold the food portions as the sets of rods are rotated about the exterior of the drum. As the sets of rods are rotated from the first location to the second location, the channel following blocks follow the channels and move closer together, resulting in the center spacing of the food portions moving closer together. At the second location, the posts of the channel following blocks enter the grooves cut in the comb style stripper and the comb style stripper lodges between the food portion and the surface of the channel following block. By pulling the comb style stripper away from the surface of the channel following block, the food portion is removed from the post.

All of the elements forming the apparatus 100 are mounted in a frame 190 for supporting the apparatus 100.

In a particular implementation, for example as shown in FIG. 5A, the second location 116 on the drum is at approximately a 6 o'clock position, i.e. at the bottom of the drum. In this position, when the food portions, indicated by reference 139 on FIG. 5B, are stripped from the posts, they fall straight down due to gravity. The food portions 139 fall a short distance onto a bottom layer of packaging film when they are stripped from the posts. The food portions are positioned on the packaging film in an arrangement which is desirable for final packaging as the spacing between the portions has been reduced from the spacing occurring at the extrusion head and which leaves room between subsets of the food portions to seal individual packages containing the respective subsets.

By transporting the food portions from a first location to a second location in the above-described manner there is less opportunity for the food portions to be damaged and the apparatus allows the spacing between food portions to be arranged with a desired spacing in an automated manner.

Automation of the apparatus may be performed, for example, by using programmable logic controllers (PLCs) to coordinate the timing of functions performed by the apparatus. For example, the PLCs may control coordination of timing of such functions as: extruding food portions onto the posts at the first location; rotating the rods around the exterior of the cylindrical drum after the food portions have been extruded onto the posts; and removing the food portions from the posts at the second location, so as to provide food portions having a desired configuration for packaging. More generally, any type or hardware, software or combination thereof can be used for controlling the apparatus. In some embodiments, the apparatus includes a computer readable media with computer readable instructions to be implemented by a processor for automating the apparatus.

The apparatus may generally be said to include a cylinder having a plurality of channels etched in an exterior surface of the cylinder. The channels are oriented in a direction substantially defining a circumference of a cylindrical cross section of the cylinder. The plurality of channels have a first spacing arrangement at a first location on the exterior surface of the cylinder and have a second spacing arrangement at a second location on the exterior surface of the cylinder. The apparatus also includes a plurality of rods, subsets of the plurality of rods being separated by an angular spacing around the circumference of the exterior surface of the cylinder and configured to rotate around the exterior surface of the cylinder. The apparatus also includes a plurality of channel following blocks, a subset of the plurality of channel following blocks slideably mounted on each of the subsets of the plurality of rods. Each of the plurality of channel following blocks is configured to receive at least one food portion, wherein when the plurality of rods are rotated around the exterior surface of the cylinder, a center spacing of food portions received at the first location is changed to a different center spacing at the second location as a function of the difference between the first spacing arrangement and the second spacing arrangement.

Figure 6:
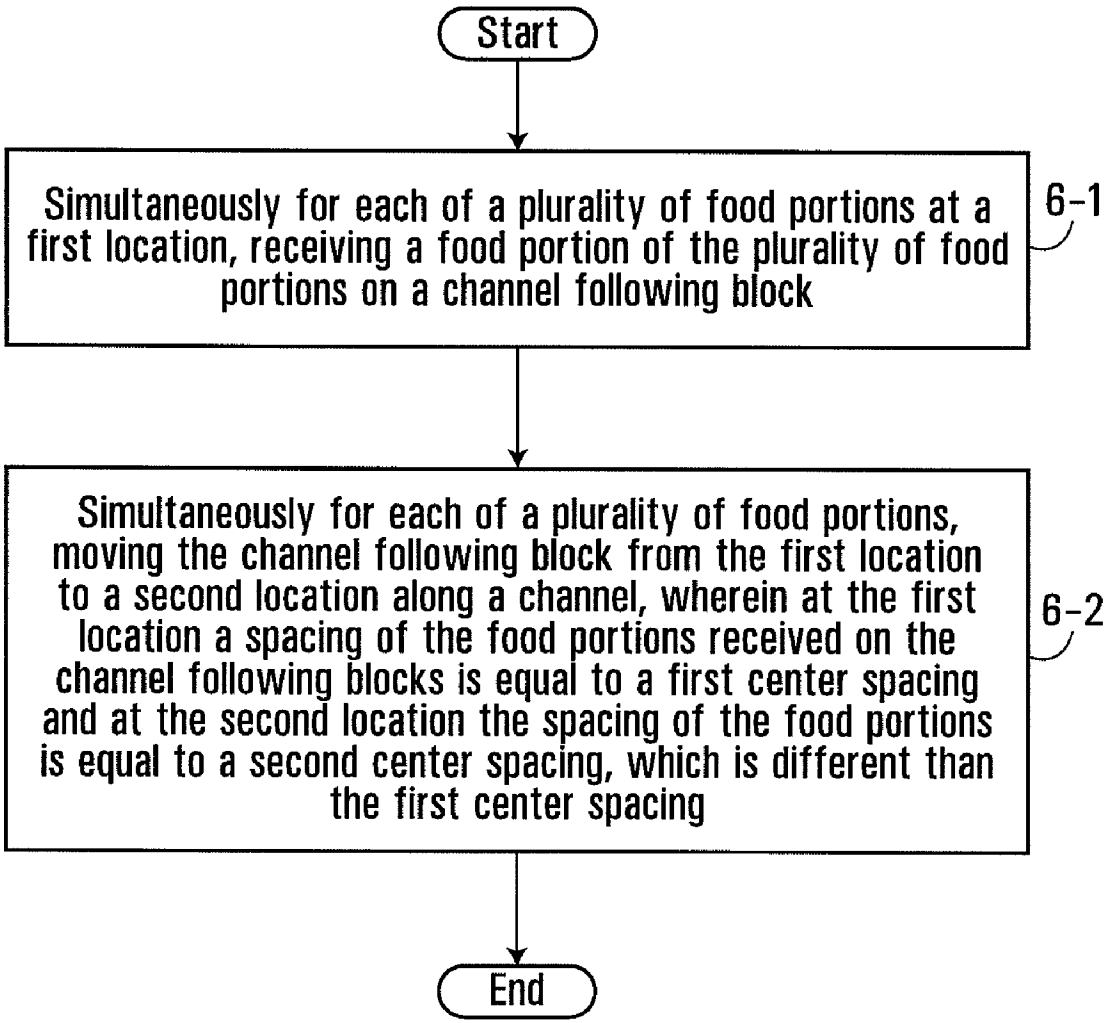
FIG. 6 is a flow chart illustrating the steps involved in a method according to an embodiment of the invention.

With reference to FIG. 6, a method for handling and placement of items on an assembly line will now be described. A first step 6-1 of the method involves, simultaneously for each of a plurality of food portions, at a first location receiving a food piece of the plurality of food pieces on a channel following block. A second step 6-2 of the method involves, simultaneously for each of the plurality of food portions, moving the channel following block from the first location to a second location along a channel, wherein at the first location a spacing of the food portions received on the channel following blocks is equal to a first center spacing and at the second location the spacing of the food portions is equal to a second center spacing, which is different than the first center spacing.

In some embodiments of the method, moving the channel following block from the first location to the second location along the channel involves moving the channel following block around an exterior of a cylinder having a plurality of channels etched in an exterior surface of the cylinder, the plurality of channels being oriented in a direction substantially defining a circumference of a cylindrical cross section of the cylinder. In some embodiments, the method also involves removing the food pieces from the channel following blocks at the second location.

An Example Implementation of the Apparatus

Figure 7A:
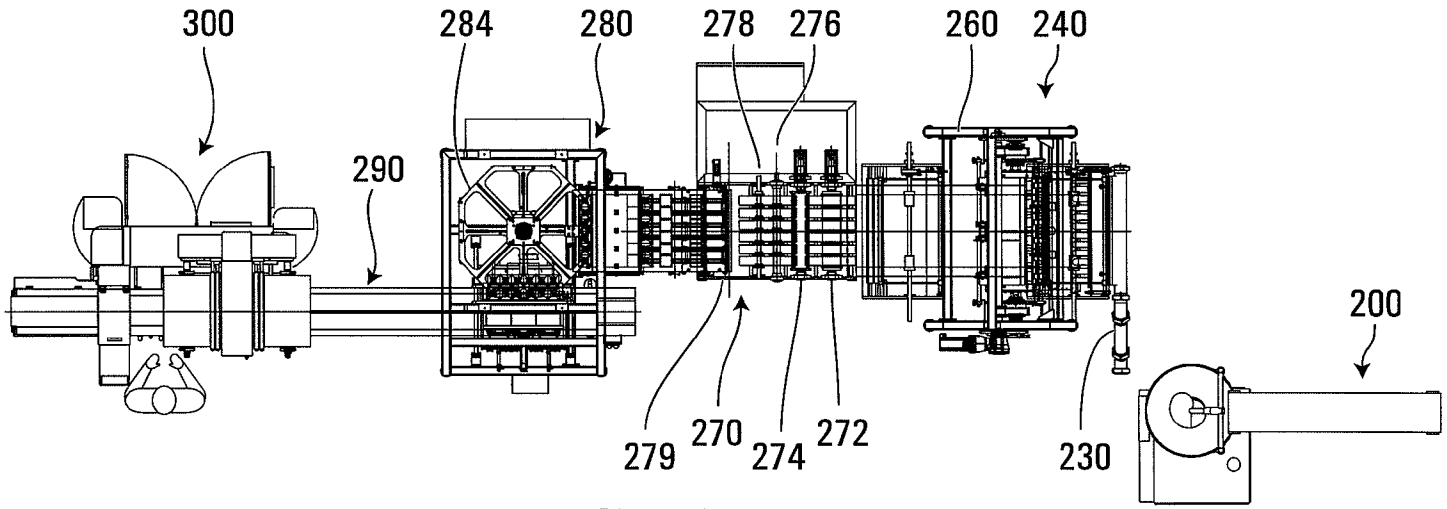
FIG. 7A is a schematic diagram of a top view of an assembly line on which an apparatus according to an embodiment of the invention may be used.
Figure 7B:
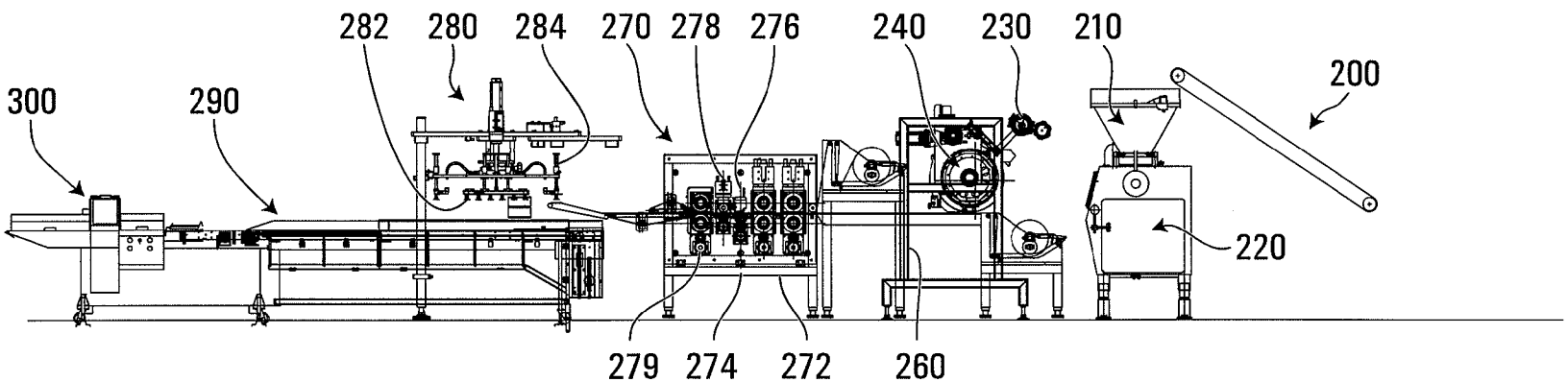
FIG. 7B is a schematic diagram of a side view of an assembly line on which an apparatus according to an embodiment of the invention may be used.

Reference will now be made to FIGS. 7A and 7B, which illustrate a particular example of an assembly line for manufacturing and packaging portions of processed cheese, the processed cheese have particular shapes. While specific examples of apparatuses are described below as part of an assembly line in connection with the center space changing apparatus described above, it is to be understood that other types of apparatuses that work in a consistent manner as those described below could be used instead of those specifically described.

The manufacturing line includes a series of apparatuses, including a center space changing apparatus of the type described above. A first apparatus is a conveyor belt 200 which loads a hopper 210 of a Reiser Vmag model #HP-15C (hereinafter referred to as Vmag) 220. An extrusion head 230 for extruding cheese portions is coupled to the Vmag 220. The center space changing apparatus 240 receives the cheese portions and changes the spacing of the cheese portions for packaging purposes. A Prodopak primary package wrapping apparatus 270 is responsible for sealing individual packages of the cheese portions once the center spacing has been changed. A secondary pick and place apparatus 280 groups the individual packages together such that they can be overwrapped as a bulk package by a Doboy Linium 301 Rotary Wrapper indicated by reference 300 (hereinafter referred to as Doboy).

In the particular implementation that utilizes the center space changing apparatus 240, portions of processed cheese are placed onto a conveyor belt 200 which loads the hopper 210 of the Vmag 220. The Vmag breaks up large portions of the processed cheese and prepares the processed cheese for extrusion. The processed cheese is equally distributed to all of the outlets of the extrusion head 230.

In this particular implementation, the extrusion head 230 has a total of twelve outlets in a single line with two distinct alternating shapes. The outlets have a center spacing of approximately 3 inches.

More generally, the extrusion head 230 could have more or less than twelve outlets, in which the outlets have any reasonable number of distinct shapes, i.e. one or more than one shape. Furthermore, the extrusion head 230 could have outlets arranged in two or more parallel rows. As the processed cheese is extruded from the extrusion head 230 as a continuous flow from each outlet, the Vmag 220 receives a signal and a wire harp cuts off a desired thickness from each extruded processed cheese flow.

The center space changing apparatus 240 receives the extruded cheese portions from the Vmag, in which the cheese portions are received with 3 inch center spacing. As an output, the apparatus 240 places the portions on a bottom layer of packaging film that is 24 inches in width, consisting of material that forms six distinct packages, each individual package being four inches wide. In the particular implementation, four cheese portions are placed on a portion of the bottom layer of packaging film forming each package. The cheese portions have an approximately 1.375 inch center spacing with respect to adjacent cheese portions. The four cheese portions are located within an approximately 2.75 inch window of the overall four inch wide package. The 2.75 inch window within the four inch width allows room to seal the packages without damaging the cheese portions.

The placement of the cheese portions on the bottom layer of the packaging film is achieved by employing the apparatus 240 as described in detail above with reference to FIGS. 1, 2, 3, 4, 5A, 5B and 5C.

Each of eight pairs of rods has twelve individual channel following blocks slideably mounted thereon. Each of the channel following blocks has two posts onto which the cheese portions are extruded. The two posts are separated by a distance of approximately 1.38 inches.

A servo motor drives the pairs of rods and channel following blocks around the drum. For a first set of extruded cheese portions, a first post of each channel following block is positioned directly under a respective outlet of the Vmag extrusion head 230. At the first location the first set of posts are positioned with three inch center spacing so that they are centered under the extrusion outlets which have a three inch center spacing. The extrusion head 230 is mounted to the frame 260 of the apparatus 240 and the clearance between the extrusion head 230 and the individual posts is set at approx 3 to 4 mm using an adjusting mechanism. The Vmag 220 cycles and twelve discrete flows are extruded from the extrusion head 230, one flow onto each respective post. A portion is cut from the extrusion flow of each outlet using the wire harp. The pairs of rods are then rotated approximately 1.38 inches, resulting in a second set of posts being positioned directly under the outlets of the extrusion head 230. The Vmag 220 cycles again and the discrete flows are further extruded from the outlets onto each post of the second set of posts and the harp is used to cut the flows, resulting in a portion on each of the posts of the second set of posts. There are now 24 cheese portions extruded onto the 24 respective posts mounted on the twelve channel following blocks slideably mounted on the pair of rods under the extrusion head 230.

A desired center spacing between adjacent food portions in each four portion package is approximately 1.38 inches. At the first location on the drum, the two portions on the same channel following block have a fixed spacing of approximately 1.38 inches and the center spacing between two portions extruded onto the posts of an adjacent channel following block is a larger than desirable spacing of 3 inches. As two adjacent channel following blocks are brought closer together during the rotation of the pairs of rods from the first location on the drum to the second location on the drum, at the second location a cheese portion has a center spacing of approximately 1.38 inches with respect to a cheese portion on the same channel following block and a cheese portion that was extruded onto on adjacent channel following block at the same time.

The pairs of rods are rotated approximately 45 degrees such that a first set of posts of a new set of channel following blocks are positioned under the extrusion head 230 and the same process described above is repeated.

When cheese portions on channel following blocks on a given pair of rods reach the second location, approximately six o'clock on the drum, the portions are stripped off the posts using the comb style stripper. In the particular embodiment, the comb style stripper is controlled by a signal that is received from a primary package wrapping apparatus 270, described in further detail below. This allows accurate placement of the cheese pieces onto the film packaging web. All 24 portions located on the two posts of the twelve channel following blocks of a pair of rods are stripped off at once placing four pieces per package, for six packages, within the designated respective 2.75 inch windows. The cycle continuously repeats.

In an alternative implementation, in which for example more than four portions are allotted to a package, there are more than only two posts per channel following block. In an implementation in which there are six portions per package, i.e. two columns of three portions, there may be three posts per channel following block. In some implementations, there may also be more, or less, than eight pairs of rods as described in the example implementation above. In an alternative implementation, when the extrusion head has two or more parallel rows of outlets, the cheese portions could be extruded onto two or more rows of posts simultaneously.

In the particular implementation, the packaging films, including a top film and bottom film that are each approximately 24 inches wide, are used to form six discrete packages across the width of the packaging films. However, more generally, the size of the packaging films is implementation specific and may be larger, or smaller, than 24 inches. Furthermore, the number of discrete packages formed from the packaging films is implementation specific. The number of discrete packages may be based on many different factors, for example, but not limited to, the size of the packaging films and the number of food portions to be included in a given package.

In the particular implementation, the bottom packaging film is a printed film, i.e. with product logo and/or other product information, and the top film is an unmarked film. Operation of the Vmag 220 and a Prodopak primary package wrapping apparatus 270 are at least in part controlled as a result of a signal received from a photoeye that reads a registration mark on the printed bottom film. Therefore, as each package, or set of six packages across the width of the continuous printed film, has a respective registration mark, the reading of the registration mark initiates advancing the film with 24 previously laid out cheese portions on it. 24 new cheese portions with the desired spacing are stripped off the posts as they arrive at the second location onto the printed film.

The top film is then placed over the cheese portions and a rotary film sealing die 272 of the Prodopak primary package wrapping apparatus 270 seals the six packages along the length of the film packaging web in the direction of travel, which are package seals between the adjacent packages. As the sealed top and bottom films advance along the assembly line more cheese portions are removed from the channel following blocks at the second location and laid on the packaging film. A rotary film sealing die 274 seals the top and bottom films in a direction perpendicular to the direction of travel and forms the seals between successive sets of six packages. The sealed top and bottom films then advance to a rotary cutting section 276 of the apparatus. Here the packages are cut into three groups of two packages, each set of two packages separated by a perforation. The packages then pass under film pull rollers 278 and then finally through a rotary horizontal knife 279 where the packages are cut into three distinct dual packs, before moving onto a discharge conveyor. The discharge conveyor carries three sets of two packages to the secondary pick and place apparatus 280.

As the packages enter the secondary pick and place apparatus 280, the packages activate a photoeye sensor under each set. When all sensors are activated a set of six suction cups 282 is lowered and picks up the three sets of two packages. The secondary pick and place apparatus 280 includes a carousel style apparatus 284 for picking up packages, rotating through 90 degrees and dropping the packages into three discrete loading bays, one loading bay for each package. To obtain three bulk packages of eight two packs each, a total of four of these cycles are performed and then bomb-bay doors open beneath the loading bays and the packages are dropped down into an infeed chain 290 of the Doboy 300. The infeed chain 290 is a conveyance device formed substantially of a chain having multiple flights attached to the chain at a discrete spacing. The flights support and push the groups of packages into the bulk package packaging.

In an alternative implementation, a twenty eight pack of individual packages (14 perforated two packs) is packaged in a bulk pack. The secondary pick and place apparatus 280 fills two sets of multiple loading bays. A first set of multiple loading bays is filled with three sets of seven dual packs. A second set of multiple loading bays is moved into position to receive a further three sets of seven dual packs. The infeed chain 290 of the Doboy 300 is set to receive two groups of seven two packs per bulk pack. The three groups of two sets of seven two packs are dropped at the same time into the infeed chain 290 of the Doboy 300 to form three distinct bulk packages containing twenty eight individual packages or fourteen two packs.

The Doboy 300 then advances and wraps the individual bulk packs. These are then put over a scale to make sure the weight is accurate and then the packages are packed into cases.

Numerous modifications and variations of the present invention are possible in light of the above teachings. It is therefore to be understood that within the scope of the appended claims, the invention may be practised otherwise than as specifically described herein.

The invention claimed is:

1. A method comprising:

simultaneously, for each of a plurality of food portions:

at a first location, receiving a food portion of the plurality of food portions on a respective channel following block;

moving the channel following block from the first location to a second location along a respective channel;

wherein at the first location a spacing of adjacent food portions of the plurality of food portions received on the respective channel following blocks is equal to a first spacing and at the second location the spacing of the adjacent food portions of the plurality of food portions is equal to a second spacing, which is different than the first spacing.

2. The method of claim 1, wherein simultaneously, for each of a plurality of food portions moving the channel following block from the first location to the second location along a respective channel comprises:

moving the respective channel following block around an exterior of a cylinder having a plurality of channels etched in an exterior surface of the cylinder, the plurality of channels being oriented in a direction substantially defining a circumference of a cylindrical cross section of the cylinder.

3. The method of claim 1 further comprising:

removing the plurality of food portions from the channel following blocks at the second location.

4. The method of claim 3, wherein removing the plurality of food portions from the channel following blocks further comprises:

the plurality of food portions being positioned on a bottom layer of packaging film and covered with a top layer of packaging film.

5. The method of claim 1 wherein the first spacing is greater than the second spacing.

6. The method of claim 1 further comprising:

extruding the plurality of food portions to be simultaneously received by the channel following blocks from an extrusion head comprising a plurality of outlets from which the food portions are extruded.

7. The method of claim 1 comprising:

at a first time, simultaneously receiving a first plurality of food portions at the first location on each channel following block of a set of channel following blocks;

at a second time moving the first set of channel following blocks away from the first location to a new position toward the second locations while moving a second set of channel following blocks toward the first location to simultaneously receive a second plurality of food portions.

8. The method of claim 7 further comprising:

removing the first plurality of food portions from each of the channel following blocks of the first plurality of channel following blocks onto a bottom layer of packaging film when they are moved at the second location;

at a subsequent time, removing the second plurality of food portions from each of the channel following blocks of the second plurality of channel following blocks onto the bottom layer of packaging film when they are moved at the second location; and covering the bottom layer of packaging film with a top layer of packaging film.

* * * * *